US005419221A

United States Patent [19]

Cole

[11] Patent Number: 5,419,221

[45] Date of Patent: May 30, 1995

[54] INDEXABLE HEAD RATCHET WRENCH

[76] Inventor: James E. Cole, P.O. Box 29911, Dallas, Tex. 75229-0911

[21] Appl. No.: 260,720

[22] Filed: Jun. 16, 1994

[51] Int. Cl.[6] ..... B25B 13/46

[52] U.S. Cl. ..... 81/60; 81/177.8; 81/58.1

[58] Field of Search ..... 81/58–58.4, 81/60–63.2, 177.7–177.9

[56] References Cited

U.S. PATENT DOCUMENTS

| | | | |
|---|---|---|---|
| 928,375 | 7/1909 | Frick | 81/177.8 |
| 1,109,032 | 9/1914 | Bersted | 81/177.8 |
| 1,568,442 | 1/1926 | Carver | 81/177.8 |
| 1,840,685 | 1/1932 | Witherup | 81/177.7 |
| 4,406,186 | 9/1983 | Gummow | 81/60 |
| 4,747,328 | 5/1988 | Howard | 81/54 |
| 4,794,829 | 1/1989 | Mosenhoeller | 81/177.8 |

*Primary Examiner*—D. S. Meislin

*Attorney, Agent, or Firm*—John M. Cone; William L. Clayborn

[57] ABSTRACT

A ratchet wrench comprises a ratchet head having a conventional ratchet system for rotating a shank about an axis. A generally cylindrically shaped connecting pin aligned along an axis parallel to the shank axis is attached to the ratchet head. The connecting pin extends through a splined orifice in a handle, thereby connecting the handle to the ratchet head. The handle is slidable between a locked position and a unlocked position on the connecting pin. When the handle is in the locked position, the ratchet wrench can be used to rotate a nut or bolt in a conventional manner. When the handle is in the unlocked position, and the ratchet wrench can be used to rapidly rotate a nut or bolt by moving the handle in a reciprocating manner. When a nut or bolt to be rotated is near an obstruction, the handle can be unlocked, rotated about the connecting pin axis, then locked, thereby adjusting the angle between the longitudinal axis of the handle and the longitudinal axis of the ratchet head. In many instances, such angular adjustment allows the ratchet wrench to be used to rotate the nut or bolt in the conventional manner while avoiding contact between the handle and the obstruction.

8 Claims, 1 Drawing Sheet

INDEXABLE HEAD RATCHET WRENCH

BRIEF SUMMARY OF THE INVENTION

The ratchet wrench of the present invention comprises a ratchet head, a connecting pin, and a handle. The ratchet head includes a conventional ratchet system for rotating a shank about an axis. A conventional socket can be connected to the shank.

The generally cylindrical connecting pin is aligned along an axis parallel to the shank axis and attached to the ratchet head. The connecting pin extends through a splined orifice in the handle, thereby connecting the handle to the ratchet head. A portion of the connecting pin includes splines adapted to engage the orifice splines in a complementary manner to prevent rotation of the handle about the connecting pin axis; and an indented portion of the connecting pin is adapted to allow the handle to rotate freely about the connecting pin axis.

The handle is slidable between a locked position and a unlocked position on the connecting pin. In the locked position, the handle orifice is disposed about the splined portion of the connecting pin, the orifice splines engage the connecting pin splines, and the ratchet wrench can be used to rotate a nut or bolt in a conventional manner. In the unlocked position, the handle orifice is disposed about the indented portion of the connecting pin and the ratchet head can rotate in a full circle about the connecting pin axis, This allows the ratchet wrench to be used to rapidly rotate a nut or bolt by moving the handle in a reciprocating manner.

When the nut or bolt to be rotated by the ratchet wrench is near an obstruction, the handle can be unlocked, rotated about the connecting pin axis, then locked, thereby adjusting the angle between the longitudinal axis of the handle and the longitudinal axis of the ratchet head. In many instances, such angular adjustment allows the ratchet wrench to be used to rotate the nut or bolt in the conventional manner while avoiding contact between the handle and the obstruction.

BRIEF DESCRIPTION OF THE DRAWINGS

An embodiment of the invention will be described, by way of example only, with reference to the accompanying drawings, in which.

DETAILED DESCRIPTION

Figure 1:
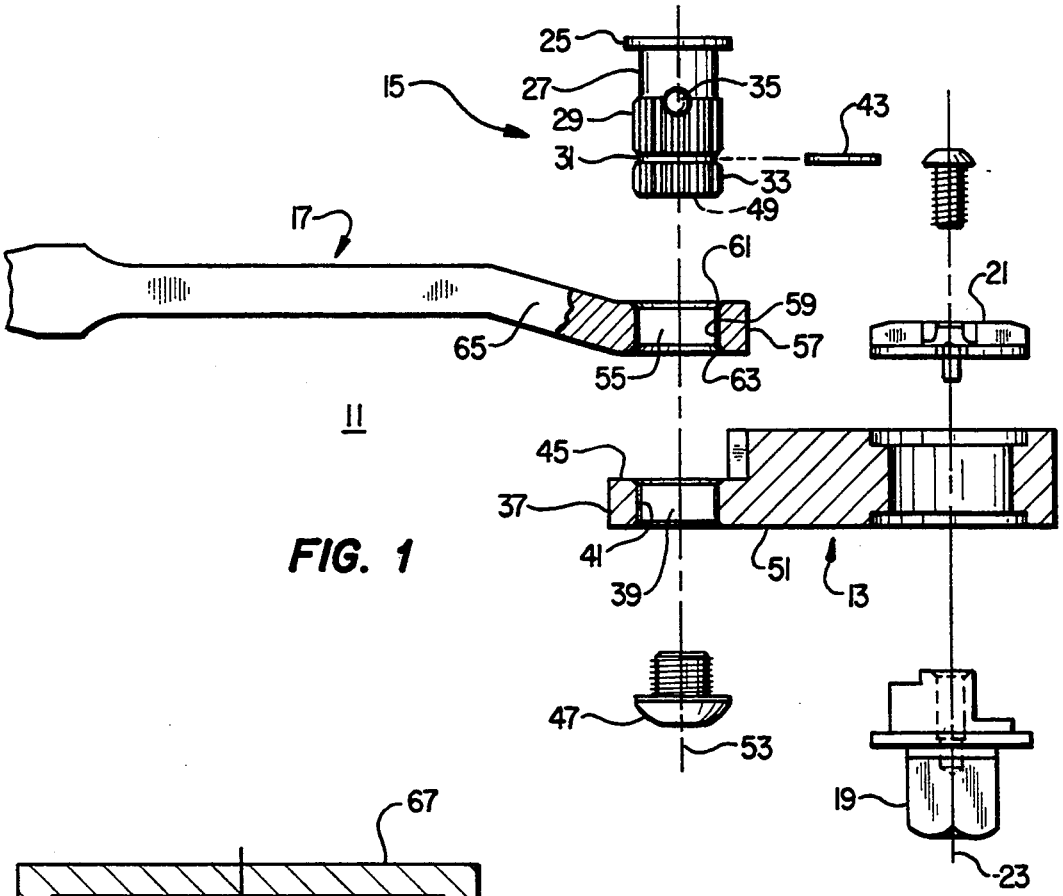
FIG. 1 is a partial, exploded side view of the ratchet wrench of the present invention.
Figure 2:
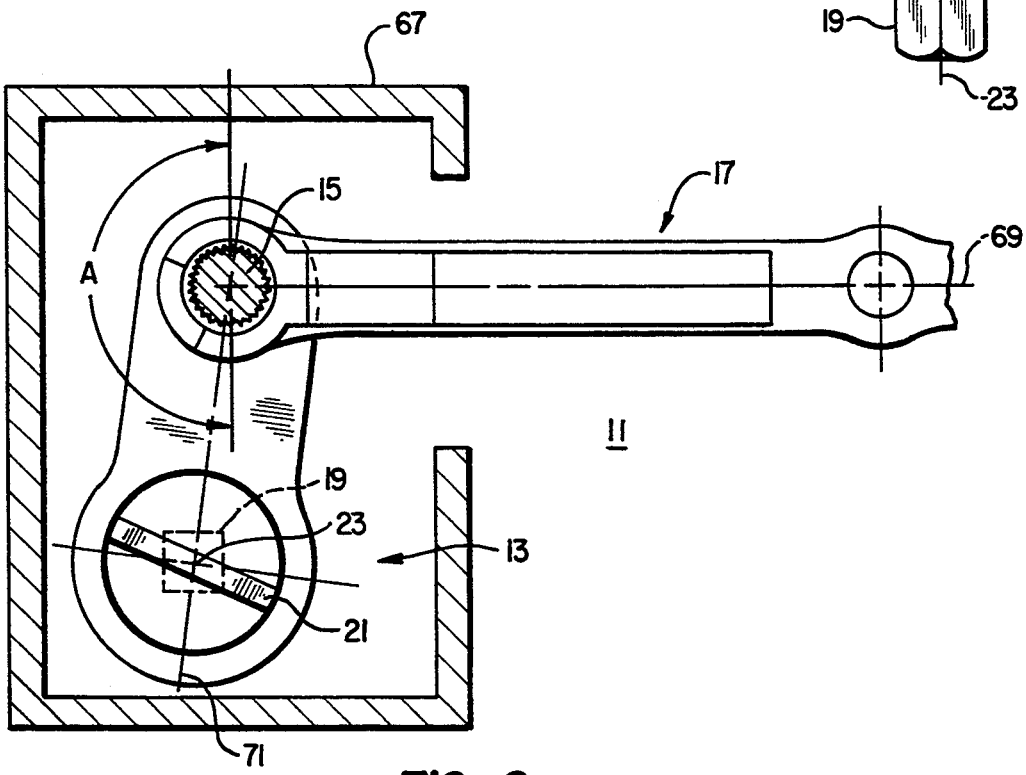
FIG. 2 is a partial top view of the ratchet wrench of FIG. 1 with the connecting pin cap cut away.

FIGS. 1 and 2 illustrate a preferred embodiment of the invention. A ratchet wrench 11 comprises a ratchet head 13, a connecting pin 15, and a handle 17. The ratchet head 13 is provided with a conventional ratchet system which includes a shank 19 and a ratchet direction selector 21. The ratchet direction selector 21 can be positioned to cause the shank 19 to drive an connected socket (not shown) clockwise or counterclockwise about the shank axis 23.

From top to bottom in FIG. 1, the generally cylindrical connecting pin 15 comprises a radially extending cap 25, an indentation 27, upper splines 29, an annular groove 31, and lower splines 33. A spring-loaded ball 35 is provided in the connecting pin 15 at the juncture of the indentation 27 and the upper splines 29.

An integral arm 37 extending from the ratchet head 13 is provided with an orifice 39 having splines 41 adapted to engage the lower connecting pin splines 33 in a complementary manner. In the assembled ratchet wrench 11, the lower connecting pin splines 33 engage the arm orifice splines 41, a retaining ring 43 installed in the connecting pin groove 31 abuts an upper surface 45 of the arm 37, and a screw 47 engaged in a threaded orifice 49 in the connecting pin 15 abuts a lower surface 51 of the arm 37. As a result, the connecting pin 15 is attached to the arm 37 and aligned along an axis 53 that is parallel to the shank axis 23. Those skilled in the art will appreciate that the connecting pin 15 can be attached to the arm by other means, such as eliminating the press fit between the arm orifice splines 41 and the connecting pin lower splines 33, thereby eliminating the need for the groove 31, retaining ring 43, screw 47, and connecting pin orifice 49, and press fitting or adhesively bonding the connecting pin 15 in the arm orifice 39.

An orifice 55 in an end 57 of the handle 17 adjacent to the ratchet head arm 37 is provided with splines 59, an upper chamfer 61, and a lower chamfer 63. In the assembled ratchet wrench 11, the handle orifice 55 is installed on the connecting pin 15 and is axially slidable thereon between an uppermost position and a lowermost position on the connecting pin 15. The connecting pin cap 25 and the ratchet head arm 37 cooperate to retain the handle end 57 on the connecting pin 15.

The detent ball 35 acts to retain the handle 17 in the uppermost and lowermost positions on the connecting pin 15. The upper and lower chamfers 61, 63, in combination with an appropriate spring load on the detent ball 35, allow the handle 17 to be moved easily between the uppermost and lowermost positions on the connecting pin 15.

When the handle 15 is in the uppermost position on the connecting pin 15, the handle orifice 55 is disposed about the connecting pin indentation 27. The diameter of the indentation 27 is slightly less than the inside diameter handle orifice splines 59. Hence, the handle 15 is free to rotate about the connecting pin 15 ("unlocked"). A stepup 65 in the handle 17 provides vertical clearance between the handle 17 and the ratchet direction selector 21, allowing the ratchet head 13 to rotate in a complete circle about the connecting pin 15. Thus, when the handle 17 is be moved in a reciprocating manner, the ratchet shank 19 and attached socket (not shown) rotate about the ratchet shank axis 23. As a result, when the handle 15 is unlocked, it can be moved in a reciprocating manner to rapidly spin a nut or bolt (not shown) on or off of a mating member (not shown). If an obstruction 67 prevents movement of the ratchet head 13 in a full circle, a combination of reciprocating handle motion and the action of the ratchet system will rotate a nut or bolt somewhat less rapidly, but more rapidly than with conventional ratchet action.

When the handle 17 is in the lowermost position on the connecting pin 15, the handle orifice 55 is disposed about the upper connecting pin splines 29 and the handle orifice splines 59 engage the upper connecting pin splines 37, thereby preventing rotation of the handle 17 about the connecting pin 15. This allows the wrench 11 to be used in the conventional manner to drive the shank 19.

The angle between the longitudinal axis 69 of the handle 17 and the longitudinal axis 71 of the ratchet head 13 can be adjusted through an angle A of 180 degrees by unlocking the handle 17, rotating it about the connecting pin 15 to the desired position, then relocking it. This allows the ratchet wrench 11 to be used in instances in which an obstruction 67 prevents use of a conventional ratchet wrench. In this embodiment of the invention, there are 24 upper connecting pin splines 31, allowing the handle 17 to be locked in 13 different angular positions.

While the upper connecting pin splines 31 and the complementary handle orifice splines 59 provide the angular adjustment means in the described embodiment, it is to be understood that that aspect of the invention is not limited to members having splined cross sections. For example, virtually any regular polygonal cross-section could be used to perform the angular adjustment function.

The invention provides a compact, versatile ratchet wrench 11 having a simple, strong means for adjusting the angle between the ratchet head 13 and the handle 17. The invention is useful in many situations in which an obstruction would prevent use of a conventional ratchet wrench. In addition, when the handle 17 is unlocked, the ratchet wrench 11 allows more rapid rotation of a nut or bolt that is possible with a conventional ratchet wrench.

While the preferred embodiment of the invention has been shown and described, it will be apparent to those skilled in this art that various modifications may be made to this embodiment without departing from the spirit of the present invention. For that reason, the scope of the invention is set forth in the following claims.

I claim:

1. A ratchet wrench comprising:

a ratchet head including a ratchet system for rotating a shank about an axis;

a handle;

a pin connecting said ratchet head and said handle, said connecting pin being aligned along an axis which is substantially parallel to the shank axis;

said connecting pin extending through an orifice in one of said ratchet head and said handle, said one having said orifice being slidable between a locked position and an unlocked position on said connecting pin;

in said unlocked position, said orifice being disposed about a portion of said connecting pin which is shaped to allow said one having said orifice to rotate about said connecting pin axis; and in said locked position, said orifice being disposed about a portion of said connecting pin which is shaped to engage said one having said orifice to prevent rotation thereof about said connecting pin axis.

2. The ratchet wrench of claim 1 wherein:

said orifice is substantially cylindrically shaped and includes a plurality of splines on an inner surface thereof, said splines having a inside diameter;

the portion of said connecting pin about which said orifice is disposed when in said unlocked position is substantially cylindrically shaped and has an outside diameter that is less than the inside diameter of the said splines in said orifice; and the portion of said connecting pin about which said orifice is disposed when in said locked position is substantially cylindrically shaped and has a plurality of splines on an outer surface thereof, which splines complement the splines in said orifice.

3. The ratchet wrench of claim 1 further comprising a radially extending cap attached to an end of said connecting pin.

4. The ratchet wrench of claim 1 further comprising a movable detent member extending radially outwardly from a central portion of said connecting pin.

5. The ratchet wrench of claim 1 wherein:

the shank extends downwardly from said ratchet head; and said connecting pin is attached to and extends upwardly from said ratchet head.

6. The ratchet wrench of claim 1 wherein:

the shank extends downwardly from said ratchet head; and said connecting pin is attached to and extends downwardly from said handle end.

7. A ratchet wrench comprising:

a ratchet head including a ratchet system for rotating a shank about an axis;

a handle:

a connecting pin aligned along an axis which is substantially parallel to the shank axis, said pin being attached to said ratchet head;

said connecting pin extending through a substantially cylindrical orifice in said handle, said handle being slidable between a locked position and an unlocked position on said connecting pin;

an inner surface of said orifice including a plurality of splines, said splines having an inside diameter;

in said unlocked position, said orifice being disposed about a substantially cylindrical portion of said connecting pin having an outside diameter less than the inside diameter of said splines in said orifice; and in said locked position, said orifice being disposed about a portion of said connecting pin having splines which compliment said splines in said orifice.

8. In a ratchet wrench comprising a handle and a ratchet head including a ratchet system for rotating a shank about an axis, wherein the improvement comprises:

a pin connecting said handle to said ratchet head, said pin having a longitudinal axis substantially parallel to said shank axis;

said connecting pin being attached to a first one of said handle and said ratchet head;

said connecting pin extending through an orifice in a second one of said handle and said ratchet head, said second one being slidable on said connecting pin;

a first portion of said connecting pin adapted to allow rotation of said second one about the longitudinal axis of said connecting pin; and a second portion of said connecting pin adapted to prevent rotation of said second one about the longitudinal axis of said connecting pin.

* * * * *